United States Patent [19]

Tamura et al.

[11] Patent Number: 4,491,161

[45] Date of Patent: Jan. 1, 1985

[54] TONER DISPENSING APPARATUS

[75] Inventors: Takashi Tamura, Higashimine; Shun Kawata, Tokyo, both of Japan

[73] Assignee: Konishiroku Photo Industry Co., Ltd., Tokyo, Japan

[21] Appl. No.: 521,940

[22] Filed: Aug. 10, 1983

[30] Foreign Application Priority Data

| | | | |
|---|---|---|---|
| Aug. 23, 1982 | [JP] | Japan | 57-146439 |
| Aug. 23, 1982 | [JP] | Japan | 57-146440 |
| Aug. 23, 1982 | [JP] | Japan | 57-146441 |
| Aug. 23, 1982 | [JP] | Japan | 57-146442 |
| Aug. 23, 1982 | [JP] | Japan | 57-146443 |
| Aug. 23, 1982 | [JP] | Japan | 57-146444 |
| Aug. 23, 1982 | [JP] | Japan | 57-146445 |
| Aug. 23, 1982 | [JP] | Japan | 57-146446 |

[51] Int. Cl.[3] ..... B65B 1/28

[52] U.S. Cl. ..... 141/364; 355/3 DD; 222/DIG. 1; 141/71; 141/320; 141/366

[58] Field of Search ..... 222/DIG. 1, 505, 561, 222/325; 141/1, 11, 71, 125, 311, 346–348, 319–322, 363–366, 284, 89; 220/345, 346; 355/3 DD; 206/633

[56] References Cited

U.S. PATENT DOCUMENTS

| | | | |
|---|---|---|---|
| 3,539,077 | 11/1970 | Drexler et al. | 222/DIG. 1 |
| 3,915,208 | 10/1975 | Anderson | 141/363 |
| 3,999,654 | 12/1976 | Pollack | 222/DIG. 1 |
| 4,062,385 | 12/1977 | Katusha et al. | 141/89 |
| 4,237,943 | 12/1980 | Ermel et al. | 141/364 |

*Primary Examiner*—Stephen Marcus
*Assistant Examiner*—Ernest G. Cusick
*Attorney, Agent, or Firm*—James E. Nilles

[57] ABSTRACT

A toner dispensing apparatus consists of a toner receiving portion and a toner container unit to be mounted on the former. The toner receiving portion has an openable cover for opening and closing an opening portion of the toner receiving portion. The toner container unit has container, a seal member for sealing an opening portion of the container, and a slide member connected with a portion of the seal member and slidable with respect to the opening portion. The seal member is torn off from the opening portion when the slide member is moved in conjunction with the opening motion of the openable cover.

11 Claims, 16 Drawing Figures

TONER DISPENSING APPARATUS

BACKGROUND OF THE INVENTION

1. Field of the Invention

This invention relates to an improvement of a toner dispensing apparatus for receiving toner from a toner container unit prepared separately in an electrostatic reproducing apparatus which uses a dry developer.

2. Description of the Prior Art

In an electrostatic reproducing apparatus using a dry two-component developer or one-component toner, toner is consumed in the process of reproduction and it becomes required to resupply toner after many copies have been reproduced. Resupply of toner is made usually by filling up toner into a toner hopper of the electrostatic reproducing apparatus from a toner container unit which houses therein toner. Toner is in the form of powder which has an average particle size of several tens microns, and hence is liable to scatter. Therefore, when toner is resupplied with the toner container unit being mounted to a toner inlet opening of the hopper, it happens very often that toner escapes or scatters to the outside and this causes contamination in the surroundings. It has been also experienced oftenly that there occurs toner contamination due to possible erroneous operation at the time of mounting the toner container unit or during other necessary operations.

From this reason, there has been proposed such a construction that a toner container unit closed by a cover is mounted on a toner hopper closed by a cover, and then the slide cover of the toner container unit and the openable cover of the toner hopper are opened at the same time. However, when both the slide cover and the openable cover are opened at the same time, toner starts to drop upon opening of the slide cover, so that the upper surface of the leading end portion of the openable cover is contaminated with toner each time. It was thus unavoidable that the opening portion of the toner hopper is subject to toner contamination, at the time when the toner container unit is removed after resupply of toner.

Further, if the toner container unit should be removed erroneously during resupply of toner, toner may scatter into the surroundings of the apparatus, thereby resulting in the uncontrollable state oftentimes.

In addition, the toner hopper has encountered the following problem to be solved. Since the hopper resupplied with toner from the toner container unit has to feed toner uniformly all over the width of recording paper, it has a length corresponding to the width of recording paper in usual cases. On the other hand, the opening portion of the toner container unit has a relatively small length, so that toner is filled into the hopper one-sidedly, if the toner container unit is mounted on the hopper and then opened to allow the toner just to drop from the toner container unit into the hopper. Development in this state may results in such a disadvantage that the toner is not agitated sufficiently in the development section and there occur variations in darkness of the copy in the widthwise direction, whereby the desired uniform development is not secured.

Further, in case toner in the toner container unit has been solidified due to moisture or so, the toner will remain in the toner container unit and will not drop into the hopper, even when the slide cover of the toner container unit and the openable cover of the hopper are opened together. In this case, therefore, resupply of toner is not attained to the desirous extent very oftenly.

Moreover, in a toner hopper having a cover which is slidable to be opened and closed, toner tends to adhere on the sliding surface and the cover suffers greater resistance in its sliding movement. And it becomes difficult to open and close the cover in not a few cases.

SUMMARY OF THE INVENTION

An object of this invention is to prevent toner contamination in the surroundings of a toner dispensing apparatus that may be caused by possible careless operation. This object is achieved by a toner dispensing apparatus having an opening portion which is opened and closed with an openable cover, featured in that the openable cover in the closed state is released from its locked state when a toner container unit is mounted against a retaining spring member provided in the opening portion of the apparatus.

Another object of this invention is to provide a toner dispensing apparatus of such a construction that its cover is opened together with a cover of the toner container unit, featured in that a slide plate capable of sliding by means of a spring is provided onto an openable cover of the apparatus, and the spring is compressed to allow the slide plate on the openable cover when the toner container unit is mounted to the opening portion of the apparatus.

Still another object of this invention is to prevent toner contamination in the surroundings of a toner dispensing apparatus that may be caused by possible careless operation. This object is achieved by a toner dispensing apparatus of such a construction that a slide cover of a toner container unit is opened and closed together with an openable cover of the apparatus in the state that the toner container unit having the slide cover at its opening portion is mounted on the opening portion of the apparatus, featured in that a locking member is provided which prevents removal of the toner container unit during the opened state of the openable cover of the apparatus.

Still another object of this invention is to permit a toner container unit to be mounted on a toner dispensing apparatus and allow toner within the toner container unit to be supplied into the apparatus positively without causing contamination in the outside. This object is achieved by a toner dispensing apparatus having an opening portion which is opened and closed with an openable cover, featured in that a toner container unit having a slide cover and a seal at its opening portion is mounted on the opening portion of the apparatus, and the slide cover is opened and the seal is torn off in conjunction with opening of the openable cover.

Still another object of this invention is to provide a toner dispensing apparatus having an openable cover which is able to slide to open and close its opening portion, featured in that a leveling plate is provided which moves in the toner dispensing apparatus together with the openable cover thereof behind opening of the openable cover.

Still another object of this invention is to provide a toner dispensing apparatus which permits toner within a toner container unit mounted thereon to drop into the apparatus without failure. This object is achieved by a toner dispensing apparatus having an openable cover which is able to slide to open and close its opening portion, featured in that the openable cover and/or the sliding portion of its sliding surface are formed with uneveness, whereby the openable cover is moved with adequate vibrations.

In other words, the toner container unit is subjected to vibrations in conjunction with opening and closing of the covers of both toner container unit and toner dispensing apparatus, so that toner is dropped to fill up the dispensing apparatus positively.

Still another object of this invention is to prevent toner contamination in the surroundings of a toner dispensing apparatus that may be caused by possible careless operation, and to supply toner within a toner container unit into the apparatus assuredly without causing such contamination in the surroundings. This object is achieved by a toner dispensing apparatus having an openable cover adapted to open and close its opening portion, featured in that a toner container unit having at its opening portion a slide cover and a seal member, the latter being torn off in conjunction with the slide cover, is mounted on the opening portion of the toner dispensing apparatus, and both the slide cover and the seal member are opened and closed together with the openable cover of the apparatus.

Still another object of this invention is to provide a toner dispensing apparatus wherein its cover is slide to be opened and closed positively. This object is achieved by a toner dispensing apparatus having an openable cover which is able to slide to open and close its opening portion, featured in that a blade is provided onto the openable cover to remove the toner having adhered on the sliding surface of the openable cover, at the time when the openable cover is closed.

Other objects and features of this invention will be apparent from the following description given with reference to the drawings.

DESCRIPTION OF THE PREFERRED EMBODIMENTS

The construction of a toner container unit is first described and then there will be described the construction and operation of a toner dispensing apparatus according to this invention, which apparatus is resupplied with toner from the toner container unit mounted thereon.

Figure 1:
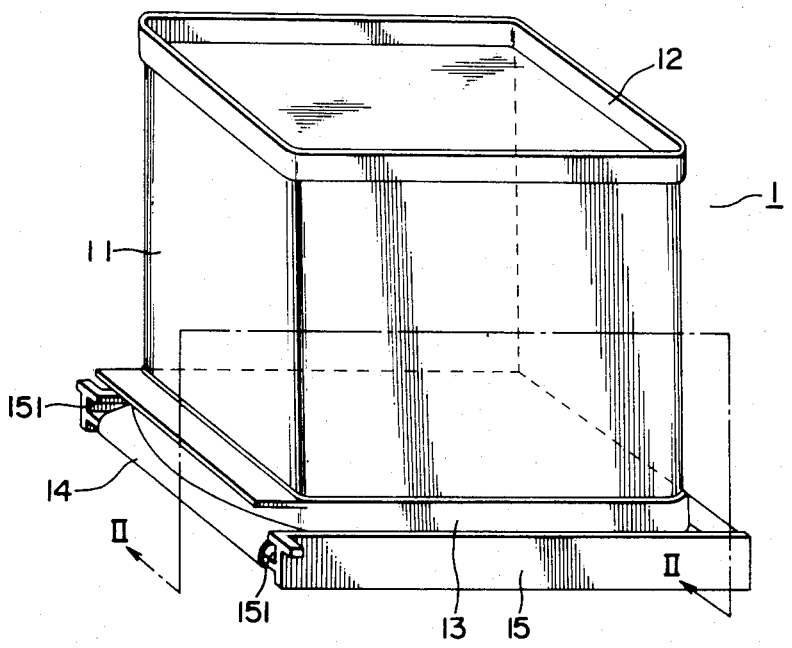
FIGS. 1, 3 and 5 are perspective views showing an external appearance of a toner circuit unit.
Figure 2:
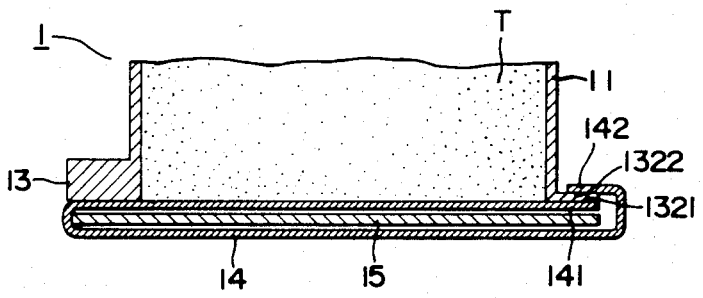
FIGS. 2 and 4 are sectional views thereof.

FIG. 1 is a perspective view showing an external appearance of a toner container unit 1 in the state its opening portion is sealed by a film-like sheet, and FIG. 2 shows a sectional view (taken along II—II in FIG. 1) of the unit 1 in the same state.

In the figures, the reference numeral 11 denotes a container body which has a tubular form opened at its at least one end, and which is formed of plastic, paper or the like. The numeral 12 denotes a fixed cover which may be formed as a plastic-molded product integrally with the container body 11.

The reference numeral 13 denotes a base portion which is attached to an opening end of the container body 11. It is also possible that the container body 11 made of plastic and molded integrally with the base portion 13. The base portion 13 is provided with a pair of projected portions 131 (FIG. 3) on the left and right sides with respect to the sliding direction, the projected portions 131 being engaged with the sliding portions of a later-described slide cover 15.

The reference numeral 14 denotes a film-like sheet for sealing an opening portion 132 of the base portion 13, which sheet is bonded by, for example, adhesives to a lower end surface 133 of the base portion 13 at the periphery of the opening portion 132 in a separatable manner. The film-like sheet 14 has its front end 141 which is rigidly bonded to a front end fixing portion 1321 locating near one end of the opening portion 132. The upper surface of the film-like sheet 14 is bonded to the lower end surface 133 in a separatable manner, and its extended portion is folded back at the seal end near the other end of the opening portion 132 so as to return passing the outer side of the slide cover 15. And a rear end 142 of the film-like sheet 14 is rigidly bonded to a rear end fixing portion 1322 locating near the front end fixing portion 1321 and constituting the upper surface thereof. The film-like sheet 14 may be formed of those materials, such as a polyester film, which are flexible and also has strength enough to resist against breakage.

The slide cover 15 serves to protect the film-like sheet 14 adapted to seal the opening portion during storage or transportation, and to open the container as required, the slide cover being made of a metal, plastic, etc. The slide cover 15 is formed with a pair of slide grooves 151 to be engaged with the paired projected portions 131 of the base portion 13. As will be seen from the sectional view of FIG. 2, toner within the container body 11 is supported by both the film-like sheet 14 and the slide cover 15 during storage or transportation.

Incidentially, the slide cover 15 may be provided with reinforcing crosspieces which extend in the sliding direction or the direction at a right angle with respect thereto, or which are arranged in the form of a lattice, as required.

Figure 3:
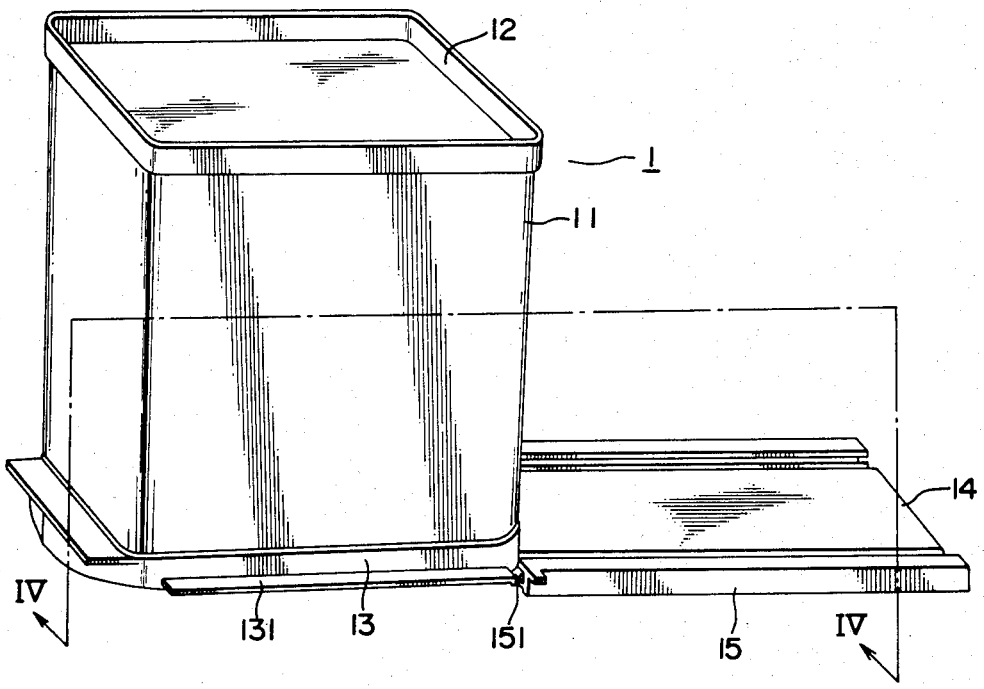
Figure 4:
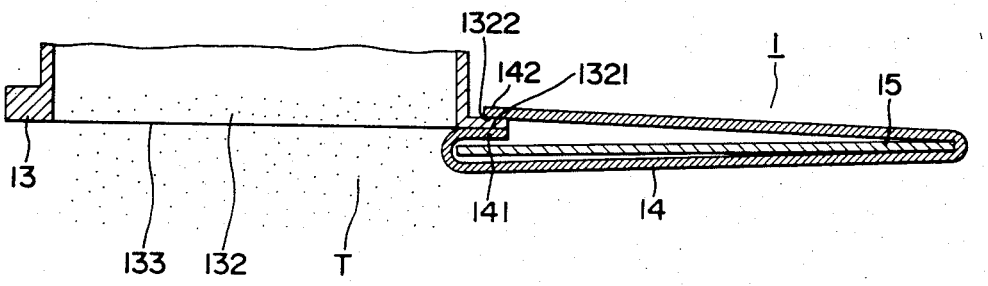
Figure 5:
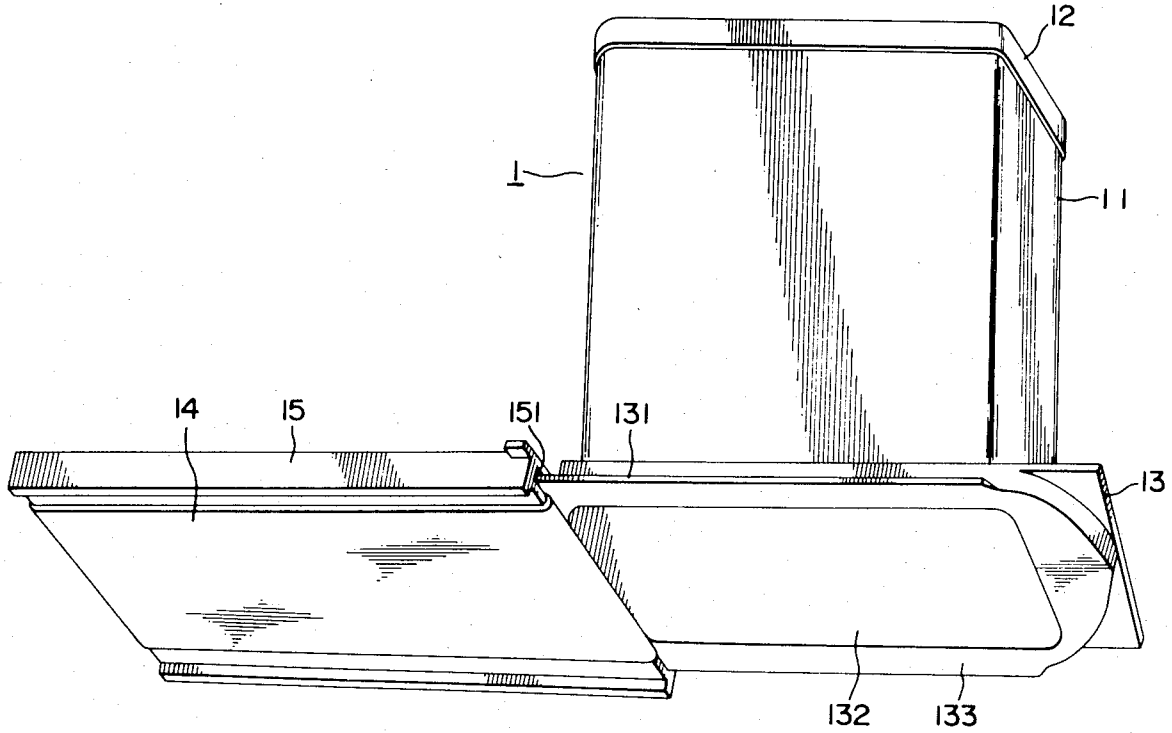

FIG. 3 is a perspective view showing the toner container unit 1 at the time of resupplying toner, FIG. 4 is sectional view (taken along IV—IV in FIG. 3) of the unit in such a state, and FIG. 5 is a perspective view showing the external appearance thereof in the same state when viewed obliquely from below.

When the slide cover 15 is drawn out toward the fixing portion 1321 (1322) (in the rightward direction on the figures), the film-like sheet 14 is also pulled together with the movement of the slide cover 15 and it is gradually torn off from the other end side of the lower end surface of the opening portion 132. In the state where the slide cover 15 is fully drawn out rightward, the opening portion 132 comes into the mostly opened state, so that toner T within the container body 11 may drop to be resupplied.

When resupply of toner is completed, the slide cover 15 is slid back leftward. With this, the film-like sheet 14 having been torn off in the above process is also returned to the original position, i.e., restored to the state as shown in FIG. 1. Then, the toner container unit 1 is removed from a hopper of a reproducing apparatus which will be described later on.

Figure 6:
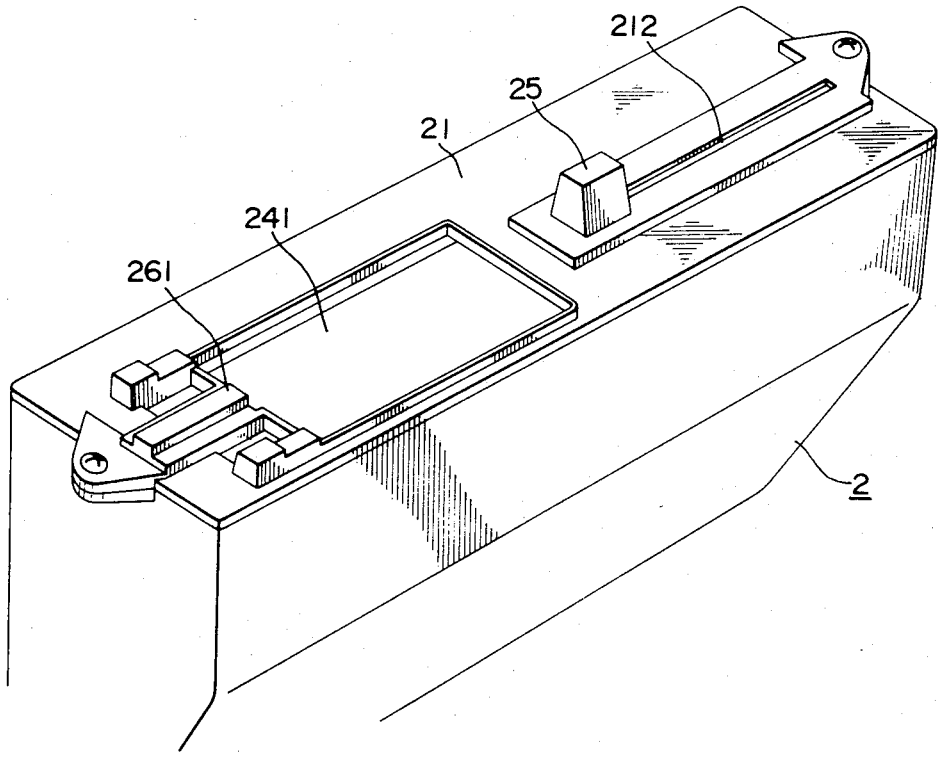
FIG. 6 is a perspective view of a toner dispensing apparatus according to this invention.
Figure 7:
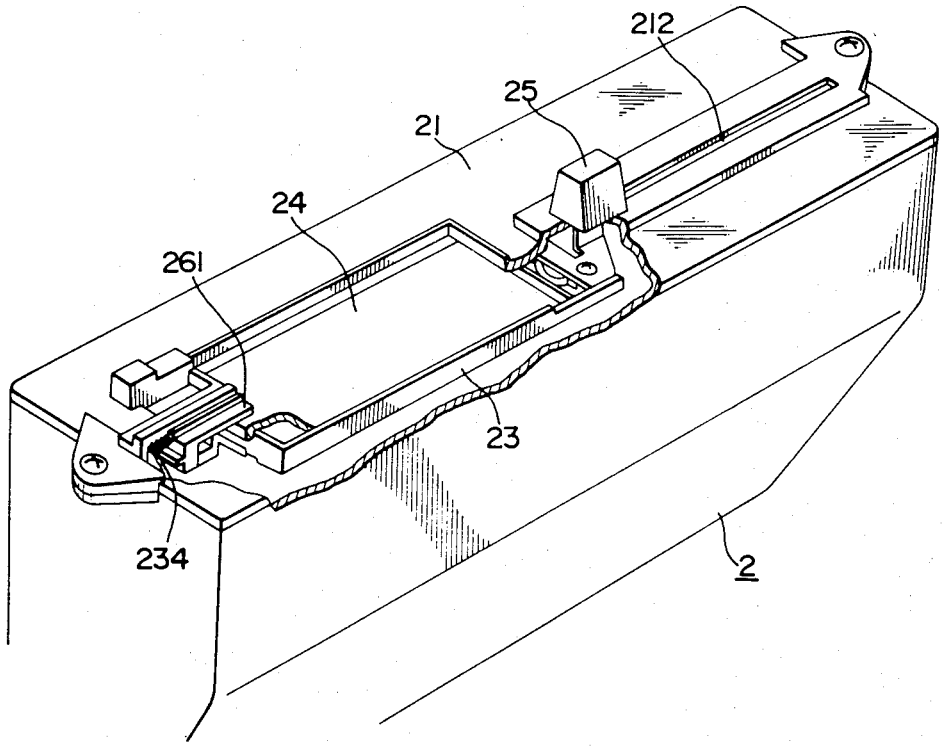
FIG. 7 is a sectional view showing an essential part thereof.
Figure 8:
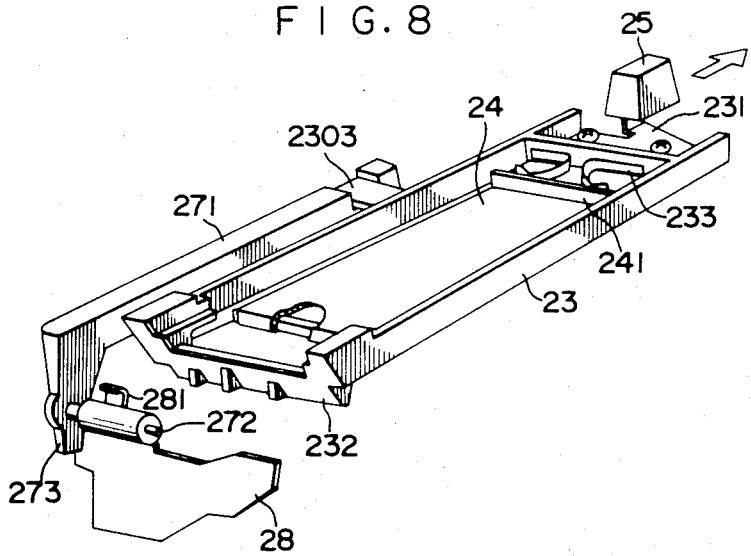
FIG. 8 is a perspective view of an openable cover.
Figure 9:
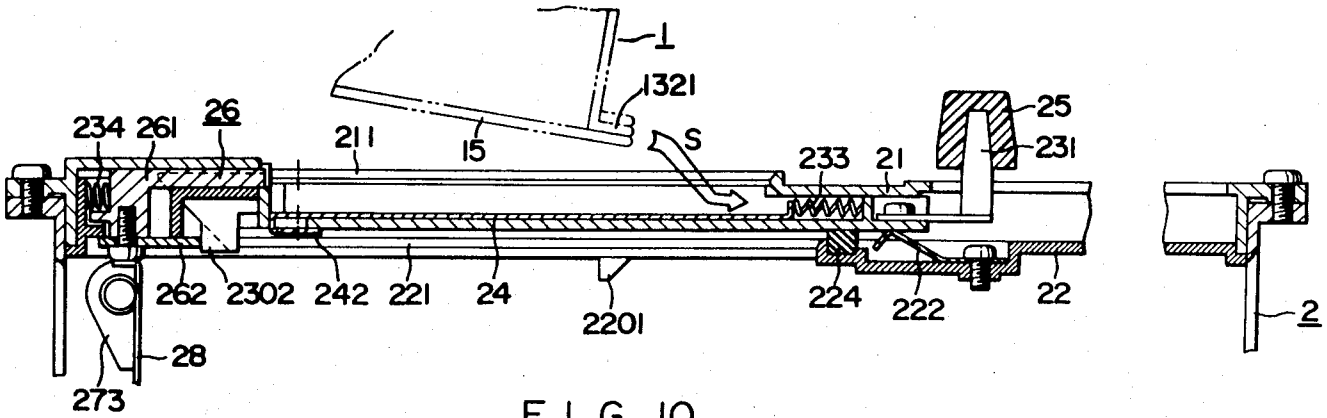
FIGS. 9, 10 and 11 are sectional views showing three different states of the toner dispensing apparatus, respectively.
Figure 10:
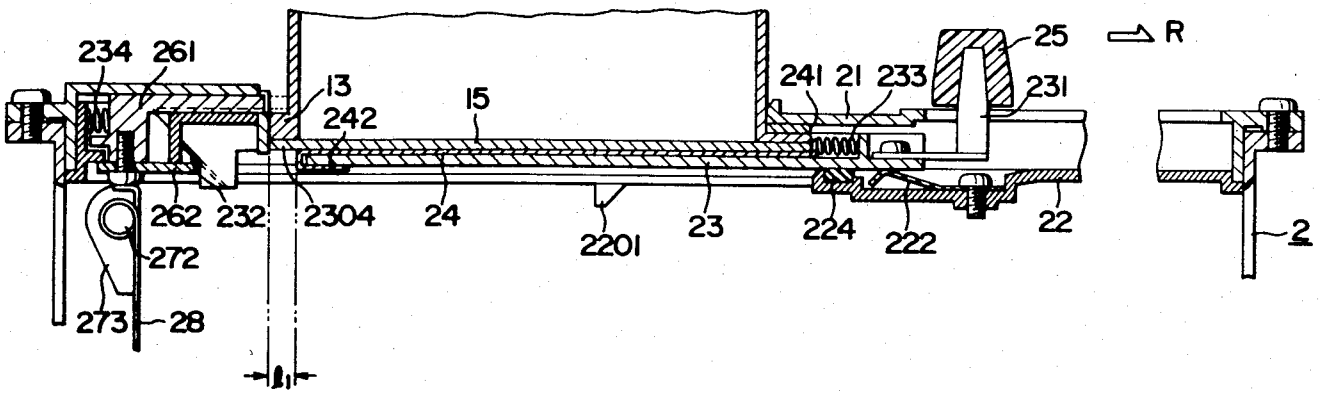
Figure 11:
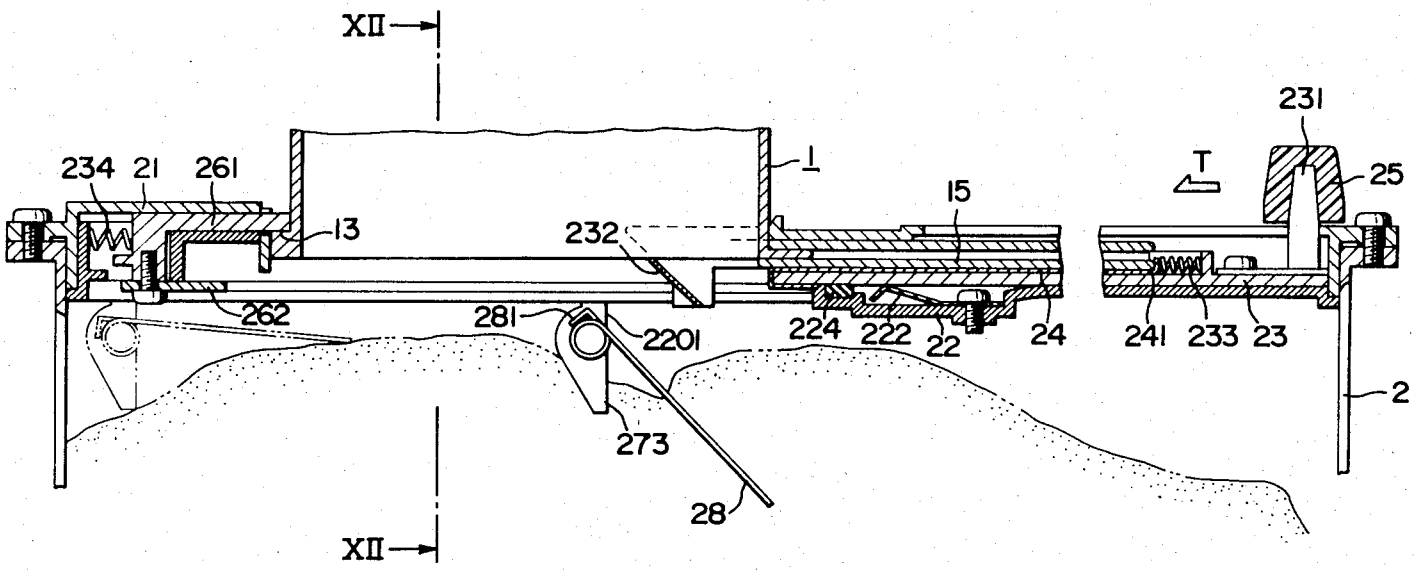
Figure 13:
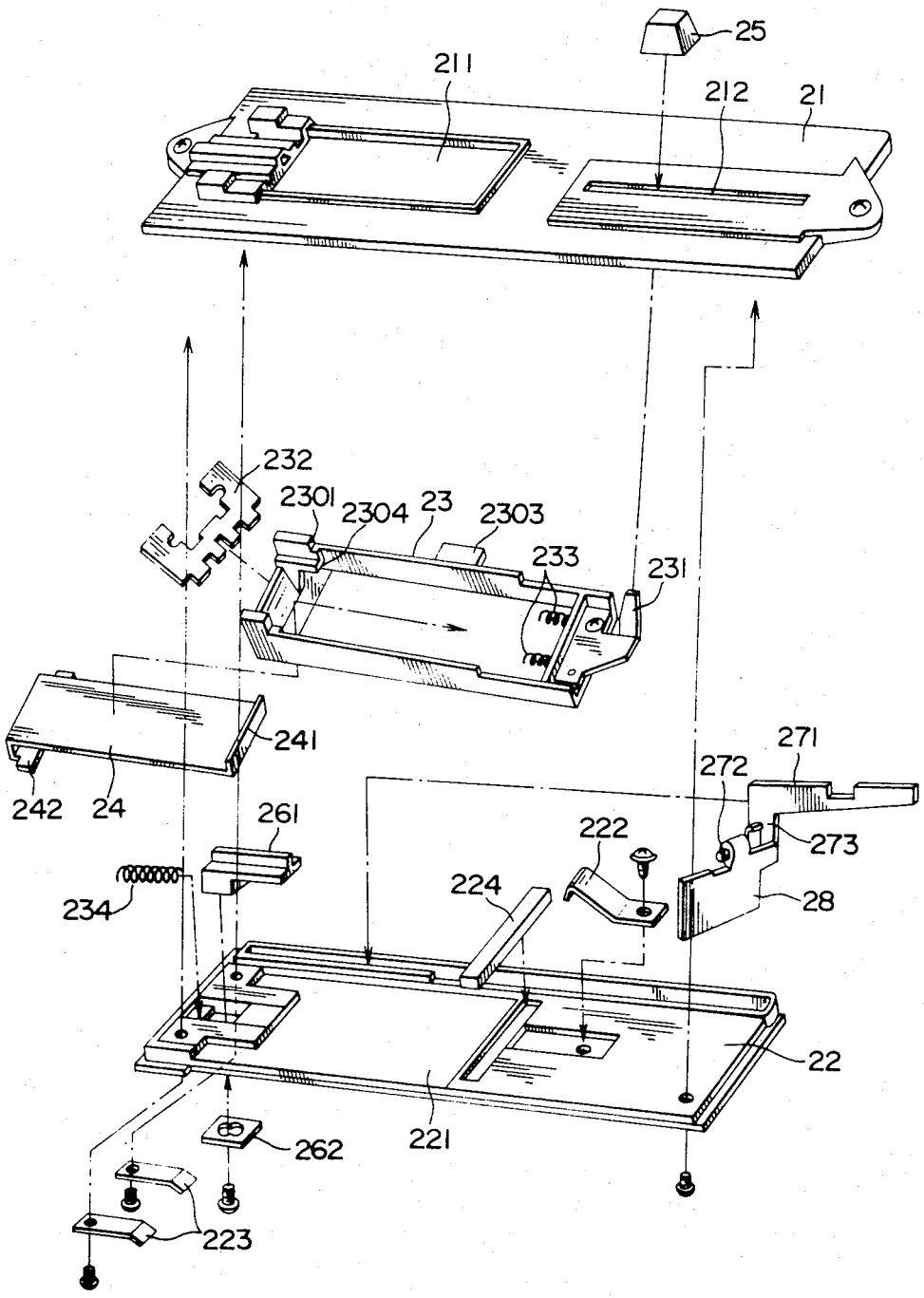
FIG. 13 is an exploded perspective view.
Figure 12:
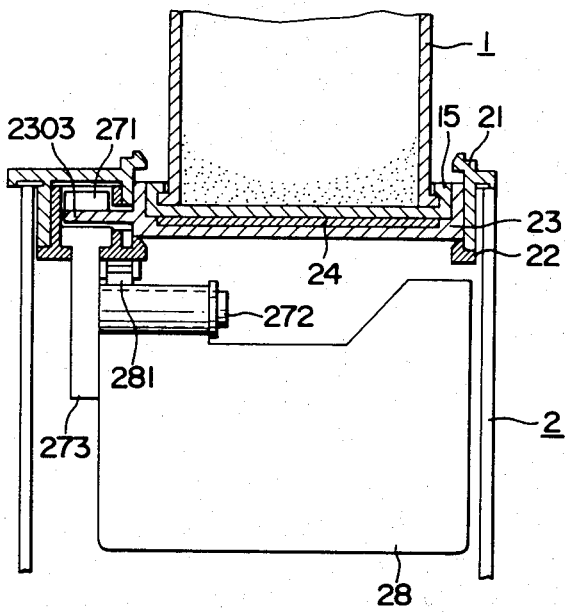
FIG. 12 is a sectional view taken along the line XII—XII in FIG. 11.

Hereinafter there will be described a toner hopper 2 according to this invention. FIG. 6 is a perspective view of the toner hopper, FIG. 7 is a sectional view showing an essential part thereof, and FIG. 8 is a perspective view of an openable cover. FIGS. 9, 10 and 11 are sectional views of the toner hopper 2, showing the different states; FIG. 9 is a sectional view showing the state where the toner container unit 1 is not yet mounted, FIG. 10 is a sectional view showing the state where the toner container unit is just mounted, and FIG. 11 is a sectional view showing the state where, after mounting of the toner container unit 1, a later-described knob 25 is moved rightward on the figure to open both container unit and hopper. FIG. 12 is a sectional view taken along XII—XII in FIG. 11. And FIG. 13 is an exploded perspective view which shows the mounting state of respective components of the toner hopper 2.

First, the construction of the toner hopper 2 according to this invention will be described by mainly referring to FIG. 13. An upper cover 21 and an intermediate cover 22 are integrally fastened to the upper surface of the toner hopper 2. The upper cover 21 is made of molded-plastic and formed with an opening 211. The intermediate cover 22 is also made of molded-plastic and formed with an opening 221 at a position corresponding to the opening 211 in the upper cover. Both openings 211 and 221 serve as an opening portion used for mounting of the toner container unit 1. Further, the upper cover 21 includes an elongated hole 212 through which the knob 25 is moved.

Interposed between the upper cover 21 and the intermediate cover 22 is an openable cover 23 slidable to open and close both openings 211 and 221. The openable cover 23 is also made of molded-plastic and has its one end to which is fixed a knob mounting plate 231. The leading end portion of the plate 231 extends upwards through the elongated hole 212 in the upper cover 21 up to above the upper cover 21, and the knob 25 is attached to the extended top end of the plate 231. The other end of the openable cover 23 forms an inclined surface projecting upwards, and a blade 232 made of an elastic thin plate according to this invention is mounted along the inclined surface. Neoprene rubber, urethane rubber, buthyl rubber, SBR rubber, NBR rubber, etc. in the shape of a sheet may be used as a material for the blade 232.

At the right end of the openable cover 23 are provided a pair of compressed springs 233, which are in abutment with a rising portion 241 formed at one end of a slide plate 24 capable of sliding on the openable cover 23, thereby to push the slide plate 24 always leftward on the figures. The other end of the slide plate 24 is bent to form a U-shaped portion 242, and the openable cover 23 is held between the horizontal two parts of the U-shaped portion 242. Stated differently, the end portion of the openable cover 23 is surrounded by the U-shaped portion 242 of the slide plate 24, thereby providing a double structure comprising the openable cover 23 and the slide plate 24.

A pushing-up spring A 222 and a pair of pushing-up springs B 223 are attached onto the surface of the intermediate cover 22 to push the openable cover 23 upwards, so that the upper surface of the openable cover 23 comes into abutment with the rear (or lower) surface of the upper cover 21. An upper end of the blade 232 abuts with the sliding surface constituting the rear surface of the upper cover 21, thereby to remove the toner having adhered onto the sliding surface when the openable cover 23 is moved leftward for closing. A packing 224 formed of a sponge material is attached onto the upper surface of the intermediate cover 22 to prevent toner from entering a space between the intermediate cover 22 and the openable cover 23.

Figure 14:
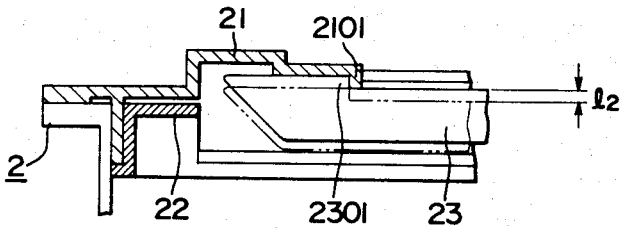
FIG. 14 is an explanatory view showing the engaged state of stepped portions.
Figure 15:
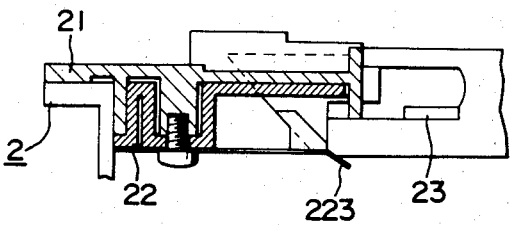
FIG. 15 is a sectional view of an essential part showing the relationship between a pushing-up spring and the openable cover.

A pair of stepped portions 2301 are formed on the upper surface of the openable cover 23 on both sides, while a pair of stepped portions 2101 are formed on the lower surface of the upper cover 21. In the closed state (FIG. 9), the openable cover 23 is pushed up by means of both the pushing-up springs A 222 and B 223, so that the stepped portions 2301 are engaged with the stepped portions 2101. FIG. 15 shows the state where the pushing-up springs B 223 pushes the openable cover 23 upwards, and FIG. 14 shows the relationship between both stepped portions in engagement with each other.

Furthermore, a lock mechanism is provided at the left end of the intermediate cover 22. More specifically, there is provided a compressed spring 234 to push a locking member 26 rightward, which is composed of a locking pawl member 261 and a locking base plate 262 coupled integrally to each other, and which is slidable leftward and rightward. The locking member 26 serves as a member for mounting and supporting the toner container unit 1, and it operates as a lock mechanism when the openable cover 23 is opened. But when the openable cover 23 is closed, a front end portion 2302 of the openable cover 23 prevents the locking member 26 from moving rightward, whereby the lock mechanism will not operate even with the toner container unit 1 being mounted.

The openable cover 23 is provided with a projected portion 2303 protruding sidewards therefrom. The projected portion 2303 is engaged with a slide member 271 which is slidable in the intermediate cover 22 together with the movement of the openable cover 23. The slide member 271 is provided with a shaft 272 extending at a right angle with respect to the sliding direction thereof and locating at a position to the left of its opening 221, and with a stopper member 273. A leveling plate 28 is attached to the shaft 272 to be rotatable thereabout. The leveling plate 28 thus provided has a function to prevent toner from being filled into the hopper one-sidedly. The leveling plate 28 is so constructed that its rotation in the clockwise direction is stopped at the vertical position by virtue of the stopper member 273, while its rotation in the counterclockwise direction is allowed up to the horizontal position. When the knob 25 is moved rightward to open the openable cover 23, the leveling plate 28 is also moved rightward together with the openable cover 23 but behind opening thereof (FIG. 11). Therefore, the leveling plate 28 is moved rightward in the toner hopper 2 while keeping its vertical attitude with the aid of the stopper member 273. In this embodiment, the toner container unit 1 is mounted to the left end of the hopper 2, so that toner is filled into the hopper 2 one-sidedly on the left side thereof. Accordingly, the toner hopper of this invention has such a construction that the toner dropped on the left side upon opening is pushed and shifted by the presence of the newly provided leveling plate 28 toward the right side where no toner drops thereinto.

In the final stroke of the rightward movement of the leveling plate 28, a projection piece 281 formed by a part of the leveling plate 28 and protruding up to above the shaft 272 strikes against a projected portion 2201 provided to protrude from the lower surface of the intermediate cover 22. With this, the leveling plate 28 is turned about the shaft 272 from its vertical attitude up to a position near the horizontal level, thereby allowing toner to spring up. This arrangement has been designed with a view of adding the action to push toner at the final position of the stroke in order to shift the toner further toward the right side, taking into account the fact that only the parallel movement of the leveling plate 28 together with the opening motion of the openable cover can not provide the sufficient effect.

Hereinafter operation of the toner hopper 2 as mentioned above will be described in relation to the mounting operation of the toner container unit 1.

Referring to FIG. 9 there is illustrated a sectional view of the toner hopper 2 in the state before mounting of the toner container unit 1, both the openings 211 and 221 of the toner hopper 2 are closed with the openable cover 23. In this state, the openable cover 23 is pushed upward by means of the pushing-up springs A 222 and B 223 to make the upper surface of the openable cover 23 coming into close contact with the rear surface of the upper cover 21 at their peripheral edge portions, whereby the toner within the toner hopper 2 is surely prevented from leaking to the outside. At the same time, the stepped portion 2101 provided on the rear surface of the upper cover 21 is engaged with the stepped portion 2301 provided on the upper surface of the openable cover 23, so that the knob 25 will not move rightward, even if so intended, because of the locked relationship therebetween. In other words, the openable cover 23 is brought into the locked state to surely hold both the openings 211 and 221 in the closed state, and it is prevented that the erroneous operation may lead to opening of the openable cover and may result in toner contamination in the surroundings of the hopper.

The toner container unit 1 is inserted into the opening 211 of the toner hopper 2 along the direction indicated by an arrow S (FIG. 9) with the fixing portion 1321 (1322) being directed ahead. The rear end (right end on the figure) of the slide cover 15 of the toner container unit 1 is brought into abutment with the rising portion 241 of the slide plate 24, and from this state the toner container unit 1 is pressed downwards obliquely to be mounted in the opening 211 while compressing the compressed spring 233. In the state as shown in FIG. 10, the slide plate 24 is shifted rightward by a distance of $l_1$, so that the front end of the openable cover (i.e., the front end 242 of the slide plate) is positioned to the right of the front end of the slide cover 15. With this arrangement, toner is prevented from adhering onto the openable cover 23 at the time of its opening.

Moreover, upon mounting of the toner container unit 1, the openable cover 23 which has been pushed up by means of both the pushing-up springs A 222 and B 223, is now sunk downward by a distance of $l_2$ (FIG. 14), whereby the locked engagement between the stepped portions 2101 and 2301 is released. As a result, the knob 25 becomes movable rightward (i.e., in the direction indicated by an arrow R in FIG. 10).

Subsequently, since a stepped portion 2304 of the openable cover 23 is now engaged with the front end of the slide cover 15 of the toner container unit 1, with the knob 25 being pulled rightward, the slide cover 15 is also moved rightward together with the openable cover 23 while tearing off the film-like sheet 14 which has been bonded to the lower end surface of the opening portion 132, whereby both the toner container unit 1 and the toner hopper 2 are opened at the same time.

When the openable cover 23 is moved rightward, the locking member 26 which has been blocked from moving by the front end portion 2302 of the openable cover 23, is now also moved rightward by a released resilient force of the compressed spring 234, thereby to lock the toner container unit 1. Accordingly, the toner container unit 1 is locked by the locking member 26 and hence can not be removed during opening of the toner container unit 1 and the openable cover 23.

In this way, upon the rightward movement of the openable cover 23, the slide cover 15 of the toner container unit 1 is opened and the seal of the film-like sheet 14 is torn off, so that the toner within the toner container unit 1 drops into the toner hopper 2. Behind dropping of the toner, the leveling plate 28 starts to move. At this time, the leveling plate 28 is pushed by the toner into the vertical position where it comes into abutment with the stopper member 273. Then, the leveling plate 28 held in the vertical attitude is moved rightward so as to sweep the inside of the toner hopper 2 and to carry the toner having been filled up mountain-high toward the right side, thereby leveling the toner within the toner hopper 2 to have a uniform level. In the final stroke, the projection piece 281 of the leveling plate 28 strikes against the projected portion 2201 formed to protrude from the lower surface of the intermediate cover 22, so that the leveling plate 28 is made to spring up in the counterclockwise direction, thereby to send the toner toward the right side with a strong force. In such a manner, it becomes possible to evenly distribute the toner over all the area in the hopper 2 and hence to carry out superior development with no uniformity in darkness of the copy.

Figure 16:
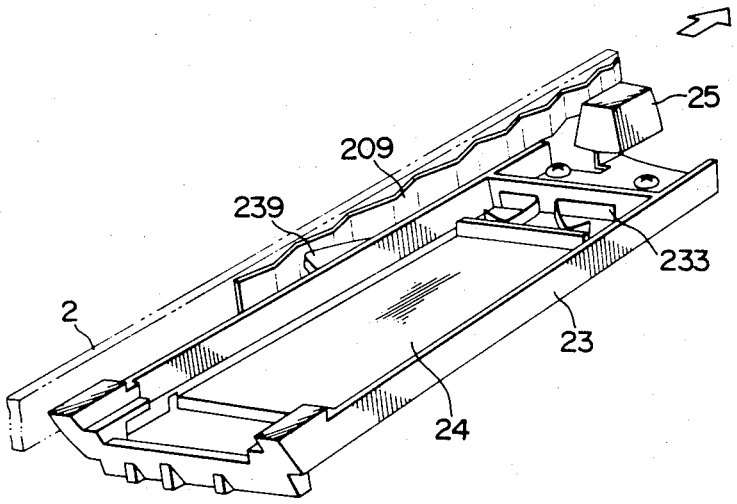
FIG. 16 is a perspective view of an essential part showing the sliding section according to one embodiment of this invention.

According to this invention, in order to surely drop the toner within the toner container unit 1 into the toner hopper 2 during the opening process of both openable cover 23 and slide cover 15 by the use of the toner hopper mounting the toner container unit, unevenness is formed on the sliding portion such as the side surface or rear surface of the openable cover 23 and/or the upper cover 21 in slide contact therewith, so that the openable cover 23 is moved passing over such unevenness. FIG. 16 is a perspective view of an essential part showing one embodiment of this invention. In this embodiment, a vibration generating section is disposed between the toner hopper 2 as a stationary part and the openable cover 23 as a slidable part. More specifically, the toner hopper 2 is provided at its side surface with an uneven plate 209 formed of a deformable leaf spring, while the openable cover 23 is provided with a projection 239 fixed to its side surface. With this arrangement, when the openable cover 23 is moved to be opened or closed, the projection 239 of the openable cover 23 passes over the uneven plate 209 with jerks, thus generating vibrations. Therefore, since there generate vibrations when the openable cover 23 is moved rightward, even such toner in the solidified state within the toner container unit 1 under influence of moisture or so can be dropped into the toner hopper through the opening portions upon opening of the slide cover 15 due to the vibrations generated.

After the completion of toner resupply, the knob 25 is moved leftward (in the direction indicated by an arrow T in FIG. 11), so that the respective components are returned to the state as shown in FIG. 10. During this return movement, the blade 232 makes a slide contact with the sliding surface constituting the rear surface of the upper cover 21 to remove the toner which has adhered onto the sliding surface when dropped. As a result, the movement of the openable cover 23 is made smooth at all times.

When the openable cover 23 is moved leftward, the leveling plate 28 is turned from its vertical attitude in the counterclockwise direction about the shaft 272, as shown by chain lines in FIG. 11, so that it returns sliding over the toner surface without moving the toner leftward.

In conjunction with closing of the openable cover 23, the slide cover 15 is also closed and the film-like sheet 14 is returned from its torn off state to the original state. At the time of closing, the openable cover 23 of the toner hopper 2 is closed behind the slide cover 15 by a distance of $l_1$, whereby the cover member of the toner hopper 2 is not contaminated with toner, even if some toner drops late.

Further, upon closing of the openable cover 23, the locking member 26 which engaged with and locked the base portion 13 of the toner container unit 1 is now pushed to retreat leftward, thereby to release the locked engagement therebetween. With the toner container unit 1 being removed from the opening 211, the openable cover 23 is pushed upward by means of both the pushing-up springs A 222 and B 223 by a distance of $l_2$, so that the stepped portions 2301 and 2101 are engaged into the locked state where the knob 25 will not move, thereby to surely inhibit the opening operation.

According to the above-mentioned toner dispensing apparatus, such as a hopper of this invention, it becomes possible to prevent toner from escaping or scattering to the outside as well as toner contamination in the surroundings of the hopper caused by possible erroneous operation, at the time of supplying toner with the toner container unit being mounted on the toner hopper.

It becomes also possible to prevent toner contamination at the opening portion of the toner dispensing apparatus. Such contamination could not be avoided in the prior art.

Further, the safety lock mechanism is provided to eliminate such a possibility that the toner container unit is erroneously removed during opening of the openable cover. As a result, the surroundings of the apparatus is positively protected from toner contamination due to erroneous operation.

Moreover, according to the toner dispensing apparatus of this invention, the toner container unit can be mounted in position without causing toner contamination in the outside.

Toner resupplied into the apparatus is not filled up one-sidedly, but distributed uniformly, thereby assuring superior development with no unevenness.

In addition to positive prevention of escaping or scattering of toner to the outside, it is secured that the toner within the toner container unit can be dropped without failure when the apparatus and the container unit are opened by moving the knob.

With the toner container unit being mounted, it is possible to surely resupply toner without causing a fear of toner contamination in the surroundings.

Furthermore, it becomes also possible to smoothly open and close the openable cover for a long term with no trouble.

What is claimed is:

1. A toner dispensing apparatus comprising a toner receiving portion having an openable cover for opening and closing an opening portion of the toner receiving portion; and a toner container unit having a container, a seal member for sealing an opening portion of the container, and a slide member connected with a portion of said seal member and slidable with respect to said opening portion, said toner container unit being able to fit with said toner receiving portion, and said seal member being torn off from said opening portion when said slide member is moved in conjunction with the opening motion of said openable cover.

2. A toner dispensing apparatus according to claim 1, wherein said openable cover in the closed state is released from its locked state when a toner container unit is mounted against a retaining spring member provided in the opening portion of said apparatus.

3. A toner dispensing apparatus according to claim 1, wherein said openable cover is opened and closed in conjunction with the movement of a knob provided outside of said opening portion.

4. A toner dispensing apparatus according to claim 1, wherein the toner container unit having the slide cover at its opening portion is mounted on the opening portion of said apparatus, the improvement in that a locking member is provided which prevents removal of the toner container unit during the opened state of the openable cover of said apparatus.

5. A toner dispensing apparatus according to claim 4, wherein said locking member serves as also a member for mounting and supporting said toner container unit.

6. A toner dispensing apparatus as set forth in claim 1, wherein a slide plate capable of sliding by means of a spring is provided onto the openable cover of said apparatus, and said spring is compressed to slide said slide plate on said openable cover when the toner container unit is mounted to the opening portion of said apparatus.

7. A toner dispensing apparatus according to claim 1, wherein a leveling plate is provided which moves in said toner dispensing apparatus together with said openable cover thereof behind opening of said openable cover.

8. A toner dispensing apparatus according to claim 7, wherein said leveling plate assumes such an attitude as permitting the leveling operation only during the opening stroke of said openable cover.

9. A toner dispensing apparatus according to claim 7 or 8, wherein said leveling plate is made turned to kick up toner at the final position in the opening stroke of said openable cover.

10. A toner dispensing apparatus according to claim 1, wherein said openable cover and/or the sliding portion on its sliding surface are formed with unevenness, whereby said openable cover is moved with adequate vibrations.

11. A toner dispensing apparatus according to claim 1, wherein a blade is provided onto said openable cover to remove the toner having adhered on the sliding surface of said openable cover, at the time when said openable cover is closed.

* * * * *